US010718199B2

(12) United States Patent
Tubel et al.

(10) Patent No.: US 10,718,199 B2
(45) Date of Patent: Jul. 21, 2020

(54) REAL TIME WELL INTEGRITY

(71) Applicant: Tubel Energy LLC, The Woodlands, TX (US)

(72) Inventors: Paulo Tubel, The Woodlands, TX (US); Clark Bergeron, The Woodlands, TX (US); Ricardo Cesar Bezerra de Melo, Madrid (ES); Forest Dickson, Spring, TX (US); Ramy Nabil Eid, Madrid (ES)

(73) Assignees: Tubel LLC, The Woodlands, TX (US); REPSOL, SA, Madrid (ES)

( * ) Notice: Subject to any disclaimer, the term of this patent is extended or adjusted under 35 U.S.C. 154(b) by 209 days.

(21) Appl. No.: 15/811,151

(22) Filed: Nov. 13, 2017

(65) Prior Publication Data

US 2019/0145243 A1 May 16, 2019

(51) Int. Cl.

| | |
|---|---|
| ***E21B 47/00*** | (2012.01) |
| ***E21B 17/02*** | (2006.01) |
| ***E21B 47/04*** | (2012.01) |
| ***E21B 47/12*** | (2012.01) |

(52) U.S. Cl.

CPC ..... *E21B 47/0005* (2013.01); *E21B 17/028* (2013.01); *E21B 47/042* (2013.01); *E21B 47/122* (2013.01)

(58) Field of Classification Search

CPC .... E21B 47/00; E21B 47/042; E21B 47/0005; E21B 47/0002; E21B 47/122; E21B 17/028

See application file for complete search history.

(56) References Cited

U.S. PATENT DOCUMENTS

2003/0058127 A1* 3/2003 Babour ..... G01V 11/002 340/854.3
2003/0066671 A1* 4/2003 Vinegar ..... E21B 47/12 174/47

(Continued)

OTHER PUBLICATIONS

Paulo Tubel, RPSEA Final Technical Report 09121-2500-01.Final, Mar. 21, 2013.

*Primary Examiner* — David Carroll
(74) *Attorney, Agent, or Firm* — Maze IP Law, P.C.

(57) ABSTRACT

Real time monitoring of a predetermined set of downhole parameters related to downhole status of a well comprises deploying a casing module as part of a casing string to a first predetermined location downhole, the casing module comprising a set of components, deploying a tubing module as part of a tubing string, typically within the casing string, where the tubing module comprises a set of tubing module components, and deploying a power generator to a distance within the well, typically as part of the tubing string and typically as part of the tubing module, and operatively connecting the power generator to the tubing module to effect power transmission from the power generator, generated downhole, to the tubing module and from the tubing wireless power transfer transmitter to the casing module. Data related to a predetermined set of downhole parameters related to downhole status of the well are transmitted from the casing module via a wireless data short hop transceiver to a tubing module wireless short hop data transceiver, the data the data and then from a surface data transceiver to a surface location.

15 Claims, 2 Drawing Sheets

(56) References Cited

U.S. PATENT DOCUMENTS

| | | | | |
|---|---|---|---|---|
| 2006/0005965 | A1* | 1/2006 | Chouzenoux ..... | E21B 47/0006 166/250.11 |
| 2015/0142319 | A1* | 5/2015 | McCoy ..... | E21B 47/0007 702/9 |

* cited by examiner

REAL TIME WELL INTEGRITY

BACKGROUND

One of the major requirements for hydrocarbon production is to obtain data from inside the well in real time. The ability to send information and commands in the well is also very important for the industry to optimize hydrocarbon production and for well integrity evaluation.

Wireless communications have been attempted inside wells with limited success. The use of batteries has limited the operating temperature of the communications system and also limited the life of the system as well the amount of data that could be transmitted to the surface. The elimination of the batteries as the primary source of power inside a well is one the most important development for the acceptance of wireless communications in wells.

Downhole power generation has also been attempted with little success. The main objection is the placement of the generator in the flow stream path in the well. The generator can fail, leading to a build-up of debris which can decrease production. The power generator in the flow stream can prevent workover tools from being deployed below the generator through the tubing. The ability to monitor the status of the cement and the casing in real time has great benefits to the operators to have advanced warning of casing collapse and cement cracks.

The major problem in placing electronics and sensors in the casing area is the short life of the power source such as batteries. The ability to have continuous power at the casing will allow for long term monitoring of the cement and casing.

Being able to communicate in real time wirelessly between the downhole and surface will allow for the production, casing and cement to be monitored in real time.

FIGURES

These and other features, aspects, and advantages of the system will become better understood with regard to the follow description, appended claims, and accompanying drawings where:

BRIEF DESCRIPTION OF EMBODIMENTS

Figure 1:
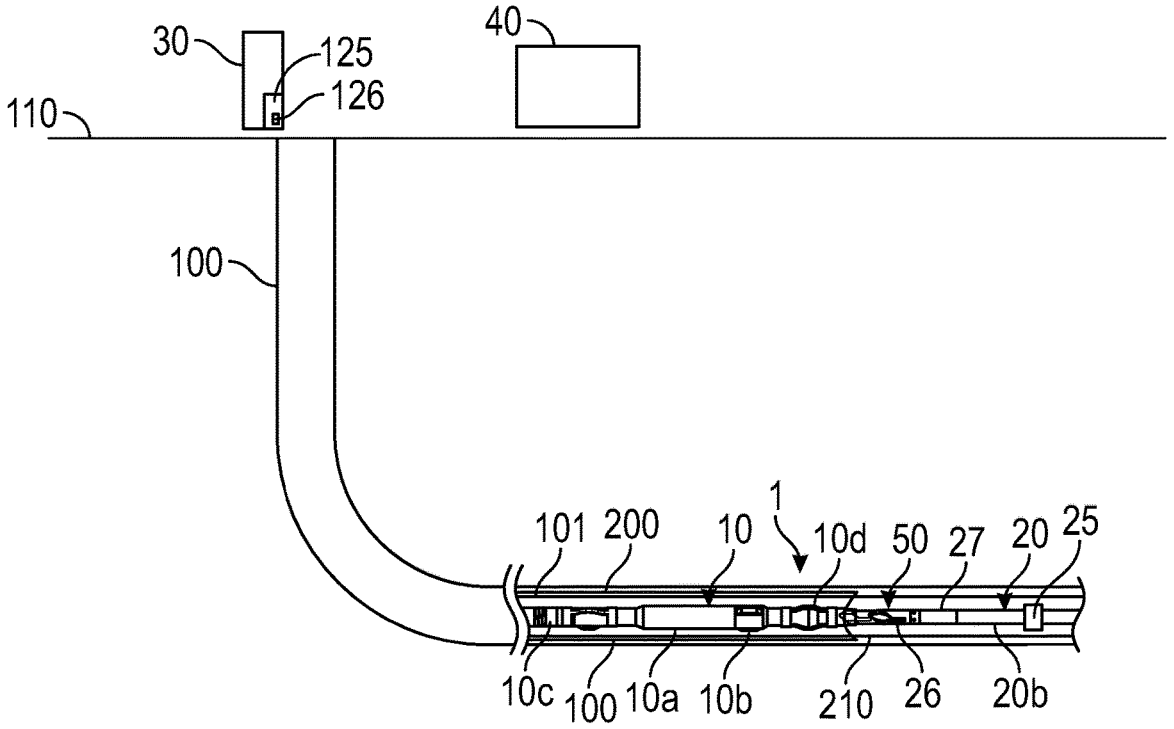
FIG. 1 is a partially cutaway schematic view illustrating exemplary system.

Referring now to FIG. 1, system 1 for real time monitoring of a predetermined set of downhole parameters related to downhole status of a well comprises casing module 10 adapted to be deployed in well 100 at a first predetermined location downhole 101, tubing module 20 adapted to be deployed downhole, and one or more power generators 25.

Figure 2:
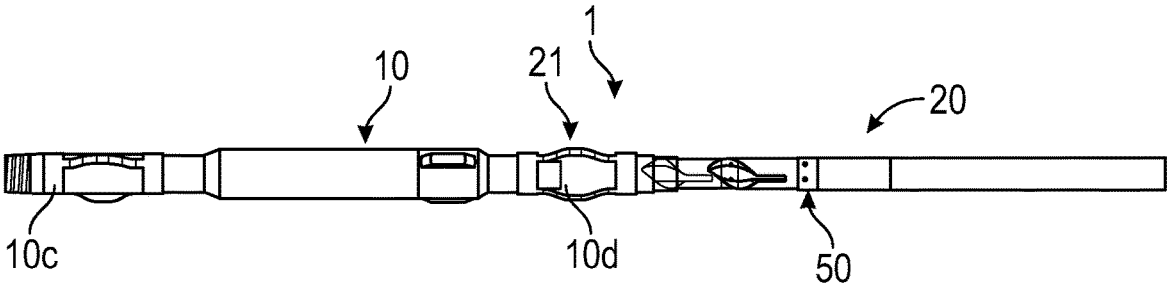
FIG. 2 is partially cutaway view in partial perspective illustrating an exemplary casing module and an exemplary tubing module.
Figure 3:
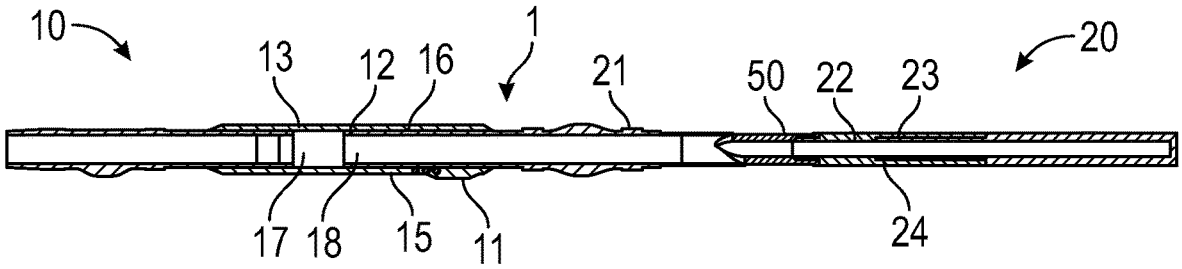
FIG. 3 is a further partially cutaway view in partial perspective illustrating an exemplary casing module and an exemplary tubing module.

Referring additionally to FIG. 3, in embodiments casing module 10 comprises upper module portion 10*b* and lower mandrel portion 10*a*, and further comprises one or more downhole parameter sensor packages 11 adapted to sense a predetermined set of downhole parameters related to downhole status of well 100; one or more casing module wireless data short hop transceivers 12 operatively in communication with downhole parameter sensor packages 11; one or more wireless power receivers 13 operatively in communication with the downhole parameter sensor packages 11 and casing module wireless data short hop transceivers 12; and one or more processors or similar electronics 16. By way of example and not limitation, redundancies in these components may be present to provide greater reliability. One or more standoffs 10*c* (FIG. 2) and 10*d* (FIG. 2) may be present at opposing ends of casing module 10.

Downhole parameter sensor packages 11 typically comprise one or more sensors, generally referred to as "50," such as sensors adapted to sense data related to life expectancy of well 100, sensors adapted to sense data related to water encroachment into a production stream, sensors adapted to sense data related to reservoir status, sensors deployed as part of cement present in well 100 or in the cement, sensors monitoring status of casing 101, or the like, or a combination thereof. In certain embodiments, sensors 50 may comprise cement status measuring sensor, casing status sensor, or the like, or a combination thereof. Although given the same callout, one of ordinary skill will understand that these sensors 50 may be similar or dissimilar.

In certain embodiments, casing module 10 further comprises one or more batteries 15, by way of example rechargeable batteries and/or supercapacitors, operatively in communication with casing module wireless data short hop transceivers 12. Typically, batteries 15 are cooperatively configured to provide power with or in lieu of power from wireless power receivers 13.

Referring still to FIGS. 1 and 3, in embodiments tubing module 20 comprises mandrel 20*b* which houses one or more tubing module wireless power transmitters 23 compatible with wireless power transfer receivers 13; one or more tubing module wireless short hop data transceivers 22 compatible with casing module wireless data short hop transceivers 12; one or more surface data transceivers 24 operatively in communication with wireless short hop data transceivers 22; and a set of production sensors 21 operatively in communication with surface data transceivers 24. As with casing module 10, by way of example and not limitation, redundancies in these components of tubing module 20 may also be present to provide greater reliability.

Figure 4:
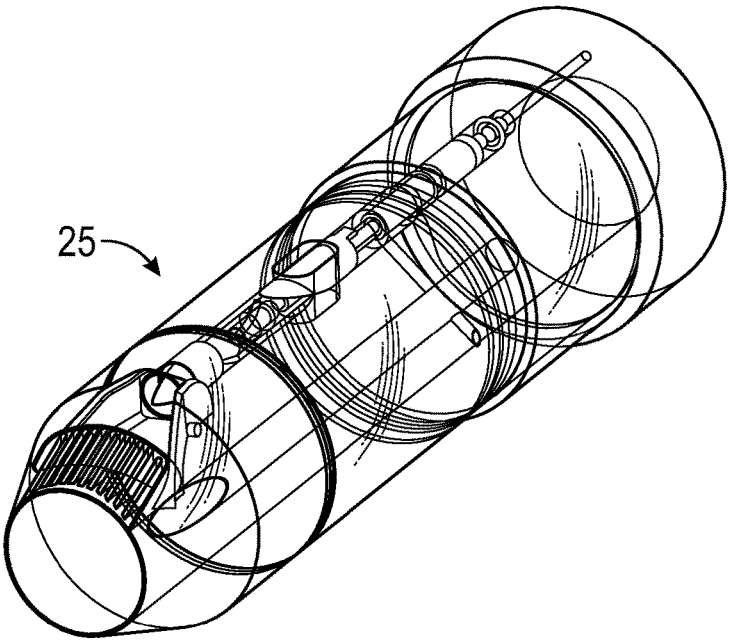
FIG. 4 is a partially cutaway view in partial perspective illustrating an exemplary power generator.

One or more power generators 25 (FIGS. 1 and 4) are also present and typically deployed as part of tubing string 210, either as part of tubing module 20 or as separate components. Power generators 25 are operative to provide electrical power to, and operatively in communication with, wireless power transmitters 23, wireless short hop data transceivers 22, surface data transceivers 24, and the set of production sensors 21 such as by a power connector (not shown in the figures) comprising a wired connection to tubing module 20, a wireless connection to tubing module 20, or the like, or a combination thereof. It is noted that power generators 25 could be located above tubing module 20, i.e. upstream, or downstream, as illustrated in FIG. 1.

As will be familiar to those of ordinary skill in electronic communications arts, it will also be noted that the various transceivers, e.g. casing module wireless data short hop transceivers 12, casing module wireless power receivers 13, tubing module wireless short hop data transceivers 22, tubing module wireless power transmitters 23, and surface data transceivers 24, typically comprise one or more antennae (not shown in the figures).

In embodiments, mule shoe 26 is a mechanical module that aligns tubing module 20 with or within casing module 10 and that, as part of the alignment, may be used to make sure that various of these various antennae, such as for power and communications transfer, align between tubing module 20 within casing module 10. As will be familiar to those of ordinary skill in these arts, other similar devices can be used as a stop/alignment tool such as a key and slot arrangement where one of casing module 10 or tubing module 20 comprises a key protrusion and the other comprises a complimentary slot adapted to receive the key protrusion and, in cases, guide the two modules until they are aligned.

In certain embodiments, antenna window 27, which may comprise a ceramic, may be present in tubing module mandrel 20*b* and allow visual access to tubing module wireless short hop data transceivers 22 and/or wireless power transmitters 23.

Referring back to FIG. 1, in certain embodiments first data processing system 30 may be present and disposed at surface location 110 proximate well 100 where first data processing system 30 comprises one or more surface data transceivers 125 configured to communicate data in real time with surface data transceivers 25 (FIG. 3). First data processing system 125 may further comprise one or more data processors 126 operatively in communication with surface data transceivers 125. In addition, data processors 126 typically comprise software to transform data received from tubing module 20 into a human perceivable representation of the data in real time.

In some embodiments, second data processing system 40 is present and operatively in communication with first data processing system 30 such as by wired connections, e.g. Ethernet, wireless communications, or the like, or a combination thereof. Second data processing system 40, if present, typically contains software useful for further processing of data received from tubing module 20.

In the operation of exemplary embodiments, referring generally to FIG. 1, real time monitoring of a predetermined set of downhole parameters related to downhole status of well 100 comprises deploying one or more casing modules 10 as part of casing string 200 to first predetermined location downhole 101, where casing module 10 is as described above. As will be familiar to those of ordinary skill in the drilling arts, casings strings such as casing string 200 are often surrounded by a material such as cement which fills and seals the annulus between the casing string and the well's drilled hole.

One or more tubing modules 20 and power generators 25 are typically deployed as part of tubing string 210 where tubing string 210 is typically deployed within, and sometimes through, casing string 200 and where tubing module 20 and power generator 25 are as described above. Tubing module 20 is typically deployed through casing module 10 until tubing module 20 gets close enough to casing module 10 to effect the wireless transmission of data and power, as described below. As noted above, power generator 25 is typically deployed in close proximity to tubing module 20 and can either be upstream or downstream from tubing module 20. As also noted above, power generator 25 is operatively in communication with tubing module 20 so as to provide power to tubing module 20.

Once deployed, tubing module 20 is aligned with casing module 10 via use of mule shoe 26 or the like when tubing module 20 gets close enough to or within casing module 10 to effect the wireless transmission of data and power, such as when tubing module 20 is proximate upper mandrel portion 10*b* of casing module 10.

In embodiments, sensors 16 are disposed in well 100 at first predetermined location downhole 101 in cement, casing string 200, or tubing string 210 present downhole in well 100.

Power generator 25 is used to generate power downhole such as by fluid flow within well 100 and the generated power operatively provided from power transmitter 25 to tubing module 20. As noted above, although illustrated at a downhole position in tubing string 210, power generator 25 may be placed anywhere along or as part of tubing string 210 or tubing module 20 to be operative.

Once operational, data may be communicated from and/or between casing module wireless data short hop transceiver 12 and tubing module wireless short hop data transceiver 22 where, as noted above, these data are related to the predetermined set of downhole parameters related to downhole status of well 100. In most embodiments, communicating data from casing module wireless data short hop transceiver 12 to tubing module wireless short hop data transceiver 22 is accomplished at low power, e.g. around 30 milliwatts. These data may further comprise data related to life expectancy of well 100, water encroachment into a production stream in well 100, cement status, reservoir status, or the like, or a combination thereof.

These data may then be communicated from surface data transceiver 24 to a surface location where this data transfer may comprise bidirectional real time communication from surface data transceiver 24 to the surface location. Surface system 30 may be used to gather the data and process the data into information that can be transferred to other computers, e.g. second system 40, or to communications modules to be provided to a well operator.

The foregoing disclosure and description of the inventions are illustrative and explanatory. Various changes may be made without departing from the spirit of the invention. Therefore, the spirit and scope of the appended claims should not be limited to the description of the exemplary embodiments contained herein.

What is claimed is:

1. A method for real time monitoring of a predetermined set of downhole parameters related to downhole status of a well, comprising:

a. deploying a casing module to a first predetermined location downhole, the casing module comprising a downhole parameter sensor configured to sense a predetermined set of downhole parameters related to downhole status of the well, a casing module wireless data short hop transceiver in communication with the downhole parameter sensor, and a casing module wireless power transfer receiver operatively in communication with the downhole parameter sensor and the casing module wireless data short hop transceiver;

b. deploying a tubing module as part of a tubing string deployed within a casing string, the tubing module comprising a tubing module wireless power transmitter compatible with the casing module wireless power transfer receiver, a tubing module wireless short hop data transceiver compatible with the casing module wireless data short hop transceiver, a surface data transceiver operatively in communication with the tubing module wireless short hop data transceiver, and a set of production sensors operatively in communication with the surface data transceiver;

c. deploying a power generator to a predetermined distance within the well;

d. operatively connecting the power generator to the tubing module to effect power transmission from the power generator to the tubing module wireless power transfer transmitter, the tubing module wireless short hop data transceiver, the surface data transceiver, and the set of production sensors;

e. aligning the casing module with the tubing module when the tubing module is at a distance relative to the casing module sufficient to effect data and power transmission between the casing module and the tubing module;

f. using the power generator to generate downhole power;

g. operatively transmitting the generated power from the power transmitter to the tubing module wireless power transfer transmitter;

h. communicating data from the casing module wireless data short hop transceiver to the tubing module wireless short hop data transceiver, the data related to the predetermined set of downhole parameters related to downhole status of the well; and i. communicating the data from the surface data transceiver to a surface location.

2. The method for real time monitoring of a predetermined set of downhole parameters related to downhole status of a well of claim 1, wherein the casing module downhole parameter sensor comprises a cement status measuring sensor or a casing status sensor.

3. The method for real time monitoring of a predetermined set of downhole parameters related to downhole status of a well of claim 1, wherein communicating data from the casing module wireless data short hop transceiver to the tubing module wireless short hop data transceiver is accomplished at low power.

4. The method for real time monitoring of a predetermined set of downhole parameters related to downhole status of a well of claim 1, wherein communicating data from the surface data transceiver to the surface location comprises bidirectional real time communication of data related to the predetermined set of downhole parameters related to downhole status of the well between the surface data transceiver and the surface location.

5. The method for real time monitoring of a predetermined set of downhole parameters related to downhole status of a well of claim 1, wherein the downhole parameter sensor is disposed in the well at the first predetermined location downhole in cement, a casing, or tubing present downhole in the well.

6. The method for real time monitoring of a predetermined set of downhole parameters related to downhole status of a well of claim 1, wherein the predetermined set of downhole parameters related to downhole status of the well comprise data related to life expectancy of the well, water encroachment into the production stream, cement status and reservoir status.

7. The method for real time monitoring of a predetermined set of downhole parameters related to downhole status of a well of claim 1, using a surface system to gather the data related to the predetermined set of downhole parameters related to downhole status of the well from downhole and to process the data related to the predetermined set of downhole parameters related to downhole status of the well into information that can be transferred to another computer or communications module to be provided to the well operator.

8. A system for real time monitoring of a predetermined set of downhole parameters related to downhole status of a well, comprising:

a. a casing module adapted to be deployed in the well at a first predetermined location downhole, the casing module comprising:

i. a downhole parameter sensor package adapted to sense a predetermined set of downhole parameters related to downhole status of the well;

ii. a casing module wireless data short hop transceiver operatively in communication with the downhole parameter sensor package; and iii. a casing module wireless power receiver operatively in communication with the downhole parameter sensor and the wireless data short hop transceiver;

b. a tubing module adapted to be deployed downhole, the tubing module comprising:

i. a tubing module wireless power transmitter compatible with the casing module wireless power transfer receiver;

ii. a tubing module wireless short hop data transceiver compatible with the casing module's wireless data short hop transceiver;

iii. a surface data transceiver operatively in communication with the wireless short hop data transceiver; and iv. a set of production sensors operatively in communication with the surface data transceiver; and c. a power generator operative to provide electrical power to the tubing module wireless short hop data transceiver, the surface data transceiver, the set of production sensors, and the casing module wireless power receiver via the tubing module wireless power transmitter.

9. The system for real time monitoring of a predetermined set of downhole parameters related to downhole status of a well of claim 8, further comprising a first data processing system disposed at a surface location proximate the well, the first data processing system comprising a surface data transceiver configured to communicate data in real time with the tubing module surface data transceiver.

10. The system for real time monitoring of a predetermined set of downhole parameters related to downhole status of a well of claim 9, wherein the first data processing system further comprises a data processor operatively in communication with the surface data transceiver.

11. The system for real time monitoring of a predetermined set of downhole parameters related to downhole status of a well of claim 9, wherein the first data processing system data processor comprises software to transform data received from the tubing module into a human perceivable representation of the data in real time.

12. The system for real time monitoring of a predetermined set of downhole parameters related to downhole status of a well of claim 9, further comprising a second data processing system operatively in communication with the first data processing system.

13. The system for real time monitoring of a predetermined set of downhole parameters related to downhole status of a well of claim 8, wherein the downhole parameter sensor package comprises a sensor adapted to sense data related to life expectancy of the well, a sensor adapted to sense data related to water encroachment into the production stream, or a sensor adapted to sense data related to reservoir status as well as sensors deployed as part of the cement or in the cement and sensors monitoring the casing status.

14. The system for real time monitoring of a predetermined set of downhole parameters related to downhole status of a well of claim 8, wherein the casing module further comprises a battery operatively in communication with the wireless data short hop transceiver, the battery cooperatively configured to provide power with or in lieu of power from the casing module wireless power receiver.

15. The method for real time monitoring of a predetermined set of downhole parameters related to downhole status of a well of claim 1, wherein the casing module is deployed as part of the casing string.

* * * * *